US007963016B2

(12) United States Patent
Ito

(10) Patent No.: US 7,963,016 B2
(45) Date of Patent: Jun. 21, 2011

(54) CIRCULAR-SHAPED METAL STRUCTURE, METHOD OF FABRICATING THE SAME, AND APPARATUS FOR FABRICATING THE SAME

(75) Inventor: Youji Ito, Tsubame (JP)

(73) Assignee: K.K. Endo Seisakusho (JP)

( * ) Notice: Subject to any disclaimer, the term of this patent is extended or adjusted under 35 U.S.C. 154(b) by 1093 days.

(21) Appl. No.: 11/739,025

(22) Filed: Apr. 23, 2007

(65) Prior Publication Data

US 2007/0186402 A1 Aug. 16, 2007

Related U.S. Application Data

(63) Continuation-in-part of application No. 10/391,862, filed on Mar. 19, 2003, now abandoned.

(30) Foreign Application Priority Data

Mar. 22, 2002 (JP) ..... 2002-81679

(51) Int. Cl.
*B23Q 17/00* (2006.01)

(52) U.S. Cl. ..... 29/407.01

(58) Field of Classification Search ..... 29/407.01, 29/407.05, 407.08, 559, 705, 707, 709, 722, 29/759, 760, 240, 281.1, 282; 72/85
See application file for complete search history.

(56) References Cited

U.S. PATENT DOCUMENTS

| | | | | |
|---|---|---|---|---|
| 1,974,441 | A | 9/1934 | Andersen | 205/137 |
| 3,826,124 | A | 7/1974 | Baksay | 72/370.25 |
| 4,173,876 | A | 11/1979 | Schaefer | 72/85 |
| 4,200,051 | A | 4/1980 | Nakahara et al. | 113/120 |
| 4,357,618 | A | 11/1982 | Ragland | 346/159 |
| 4,987,046 | A | 1/1991 | Kutami et al. | 430/127 |
| 5,035,197 | A | 7/1991 | Enoguchi et al. | 399/280 |
| 5,121,139 | A | 6/1992 | Burke | 346/136 |
| 5,128,091 | A | 7/1992 | Agur et al. | 264/512 |
| 5,321,889 | A | 6/1994 | Watanabe | 29/895.3 |
| 5,324,248 | A | 6/1994 | Quigley | 492/50 |
| 5,580,405 | A | 12/1996 | Palmer | 156/73.1 |
| 5,669,578 | A | 9/1997 | Ma | 242/613.5 |
| 6,014,999 | A | 1/2000 | Browne | 156/512 |
| 6,106,762 | A | 8/2000 | Agur et al. | 264/512 |
| 6,110,629 | A | 8/2000 | Ehara et al. | 430/84 |
| 6,716,148 | B1 | 4/2004 | Fortin et al. | 492/47 |
| 2002/0025486 | A1 | 2/2002 | Nukada et al. | 430/112 |
| 2002/0146259 | A1 | 10/2002 | Zhou et al. | 399/329 |

FOREIGN PATENT DOCUMENTS

| | | | |
|---|---|---|---|
| DE | 300696 | 7/1992 | 72/85 |
| EP | 1106278 | 6/2001 | |
| JP | 53-46472 | 4/1978 | |
| JP | 57-056118 | 4/1982 | |

(Continued)

*Primary Examiner* — John C Hong
(74) *Attorney, Agent, or Firm* — Hayes Soloway P.C.

(57) ABSTRACT

A method of fabricating a circular-shaped metal structure includes the steps of (a) rotating a pipe around an axis thereof, the pipe being composed of a plastic-workable metal, (b) moving a jig towards the pipe in a direction perpendicular to the axis until the jig makes contact with an outer surface of the pipe, and compressing the jig onto the pipe, (c) moving the jig in a direction in parallel with the axis with the jig being compressed onto the pipe while the pipe is kept rotated, (d) measuring a thickness of a wall of the pipe during the step (c), and (e) adjusting a pressure with which the jig is compressed onto the pipe, in accordance with the thickness measured in the step (d).

11 Claims, 8 Drawing Sheets

FOREIGN PATENT DOCUMENTS

| | | | |
|---|---|---|---|
| JP | 57-085618 | 5/1982 | |
| JP | 58-35025 | 3/1983 | |
| JP | 58-84619 | 5/1983 | |
| JP | 58-107223 | 6/1983 | |
| JP | 58-107224 | 6/1983 | |
| JP | 61-107008 | 5/1986 | |
| JP | 64-034527 | 2/1989 | |
| JP | 01-130822 | 5/1989 | |
| JP | 07-284452 | 10/1995 | |
| JP | 09-085355 | 3/1997 | |
| JP | 09-140583 | 6/1997 | |
| JP | 10-010893 | 1/1998 | |
| JP | 10140387 | 5/1998 | |
| JP | 2001-225134 | 8/2001 | |
| JP | 2001-330081 | 11/2001 | |
| JP | 2002-169392 | 6/2002 | |
| SD | SU 1750796 | 7/1992 | ..... 72/85 |

CIRCULAR-SHAPED METAL STRUCTURE, METHOD OF FABRICATING THE SAME, AND APPARATUS FOR FABRICATING THE SAME

CROSS REFERENCE TO RELATED APPLICATION

This application is a continuation-in-part of U.S. application Ser. No. 10/391,862, filed Mar. 19, 2003, now abandoned which application in turn claims priority from Japanese Application Serial No. 2002-81679 filed Mar. 22, 2002.

BACKGROUND OF THE INVENTION

1. Field of the Invention

The invention relates to a thin-walled circular-shaped metal structure and a method of fabricating the same, and more particularly to such a metal structure usable as a photosensitive drum or a fixing roller in an electrophotographic printer or copier, and a method of fabricating the same.

2. Description of the Related Art

For instance, Japanese Patent Application Publication No. 2001-225134 has suggested a method of fabricating a circular-shaped metal structure, including the steps of rotating a pipe around an axis thereof, and compressing a jig onto an outer surface of the pipe while the pipe is kept in rotation. The pipe is composed of a plastic-workable metal, and has a bottom or no bottom. The method reduces a thickness of a wall of the pipe, and lengthens a length of the pipe.

However, the above-mentioned method is accompanied with a problem that it is quite difficult or almost impossible to keep a thickness of a wall of the pipe constant, and to accomplish a desired outer diameter of the pipe, because the pipe is lengthened in an axial direction by reducing a thickness of a wall of the pipe.

In addition, if a pipe a wall of which has a quite small thickness is fabricated in accordance with the above-mentioned method, it is necessary to compress a jig onto a wall of the pipe a plurality of times.

SUMMARY OF THE INVENTION

In view of the above-mentioned problems in the conventional method of fabricating a circular-shaped metal structure, it is an object of the present invention to provide a circular-shaped metal structure having a wall having both a constant thickness and a constant outer diameter.

It is also an object of the present invention to further provide a method of fabricating the same, and an apparatus for fabricating the same both of which can keep a thickness of a wall constant, and further keep an outer diameter of a wall constant.

It is further an object of the present invention to provide a circular-shaped metal structure having a quite thin wall, a method of fabricating the same, and an apparatus for fabricating the same.

In one aspect of the present invention, there is provided a circular-shaped metal structure fabricated by plastic working and having a thickness with a tolerance equal to or smaller than ±2.5 micrometers. For instance, the plastic working is spinning working.

In the specification, the term "circular-shaped metal structure" covers a structure composed of a metal and having a cross-section in a direction perpendicular to an axis thereof which is closed and is in the form of a loop. For instance, a typical circular-shaped metal structure is a metal cylinder. A belt, a sleeve, a pipe and the like are all included in a circular-shaped metal structure.

The circular-shaped metal structure may include a seam extending in an axis-wise direction thereof. However, it is preferable that the circular-shaped metal structure includes no seams extending in an axis-wise direction thereof.

There is further provided a circular-shaped metal structure fabricated by plastic working and having a thickness smaller than 0.03 mm.

A fixing roller or fixing film to be used in an electrophotographic printer or copier, having a smaller volume may be heated in a shorter period of time to a desired temperature with smaller power consumption. Hence, the circular-shaped metal structure having a thickness smaller than 0.03 mm can reduce a period of time necessary for heating itself, and further reduce power consumption for heating itself.

In addition, since the circular-shaped metal structure has a thickness smaller than 0.03 mm by applying plastic-working thereto, the circular-shaped metal structure could have a higher strength than a circular-shaped metal structure fabricated by forging.

For instance, power consumption in a printer or copier can be reduced by using a nickel film as a fixing film. However, since a nickel film having been conventionally used as a thin film is fabricated by electrocasting, the thus fabricated nickel film has a columnar crystal structure, and resultingly, has a shortcoming that it is weak to a repeated mechanical stress.

A circular-shaped metal structure may be fabricated by a method including the steps of rounding a thin film, and welding the thus rounded film into a cylinder-shaped film. According to the method, any metal may be used for fabricating a metal cylindrical film.

However, the method is accompanied with such a problem of shortage in a mechanical strength and non-uniformity in a shape of a cylinder, due to a bead treatment applied to a welded portion, and further due to a defect in a welded portion with respect to a metal structure. In addition, since a metal cylindrical film is fabricated in the method by splicing thin films to each other, a skill is required and it takes much time to do so, resulting in an increase in cost and absence of mass-productivity. Hence, the method is not put to practical use yet.

In order to solve the above-mentioned problems, there is still further provided a circular-shaped metal structure fabricated by plastic working and having opposite opening ends wherein an outer diameter of said opening ends has a tolerance equal to or smaller than 0.05%.

In another aspect of the present invention, there is provided a method of fabricating a circular-shaped metal structure, including the steps of (a) rotating a pipe around an axis thereof, the pipe being composed of a plastic-workable metal, (b) moving a jig towards the pipe in a direction perpendicular to the axis until the jig makes contact with an outer surface of the pipe, and compressing the jig onto the pipe, (c) moving the jig in a direction in parallel with the axis with the jig being compressed onto the pipe while the pipe is kept rotated, (d) measuring a thickness of a wall of the pipe during the step (c), and (e) adjusting a pressure with which the jig is compressed onto the pipe, in accordance with the thickness measured in the step (d).

For instance, the plastic-workable metal may be selected from a group consisting of stainless steel, rolled nickel, nickel alloy, titanium, titanium alloy, tantalum, molybdenum, hastelloy, permalloy, marageing steel, aluminum, aluminum alloy, copper, copper alloy, pure iron and steel.

There is further provided a method of fabricating a circular-shaped metal structure, including the steps of (a) rotating a pipe around an axis thereof, the pipe being composed of a plastic-workable metal, (b) moving a plurality of jigs towards the pipe in different directions from one another in a plane perpendicular to the axis until the jigs make contact with an outer surface of the pipe, and compressing the jigs onto the pipe, and (c) moving the jigs in a direction in parallel with the axis with the jigs being compressed onto the pipe while the pipe is kept rotated.

It is preferable that the jigs are arranged around the pipe such that each of the jigs is equally spaced away from adjacent ones in a circumference angle. For instance, the number of the jigs is three, in which case, the jigs are arranged in 120 degrees circumferentially around the pipe.

There is still further provided a method of fabricating a circular-shaped metal structure, including the steps of (a) rotating a pipe around an axis thereof, the pipe being composed of a plastic-workable metal, (b) moving a jig towards the pipe in a direction perpendicular to the axis until the jig makes contact with an outer surface of the pipe, and compressing the jig onto the pipe, (c) moving the jig in a direction in parallel with the axis with the jig being compressed onto the pipe while the pipe is kept rotated, and (d) controlling a rate at which the jig is moved in the step (c).

In still another aspect of the present invention, there is provided an apparatus for fabricating a circular-shaped metal structure, including (a) a pipe rotator which rotates a pipe around an axis thereof, the pipe being composed of a plastic-workable metal, (b) a jig, (c) a first device which moves the jig towards the pipe in a direction perpendicular to the axis until the jig makes contact with an outer surface of the pipe, and compresses the jig onto the pipe, (d) a second device which moves the jig in a direction in parallel with the axis with the jig being compressed onto the pipe while the pipe is kept rotated, (e) a third device which measures a thickness of a wall of the pipe, and (f) a fourth device which adjusts a pressure with which the jig is compressed onto the pipe, in accordance with the thickness measured by the third device.

It is preferable that the jig has an acute-angled top.

The jig may be comprised of a roller.

There is further provided an apparatus for fabricating a circular-shaped metal structure, including (a) a pipe rotator which rotates a pipe around an axis thereof, the pipe being composed of a plastic-workable metal, (b) a plurality of jigs, (c) a first device which moves the plurality of jigs towards the pipe in different directions from one another in a plane perpendicular to the axis until the jigs make contact with an outer surface of the pipe, and compresses the jigs onto the pipe, (d) a second device which moves the jigs in a direction in parallel with the axis with the jigs being compressed onto the pipe while the pipe is kept rotated.

It is preferable that the jigs are arranged around the pipe such that each of the jigs is equally spaced away from adjacent ones in a circumference angle. For instance, the number of the jigs is three, in which case, the jigs are arranged in 120 degrees circumferentially around the pipe.

There is still further an apparatus for fabricating a circular-shaped metal structure, including (a) a pipe rotator which rotates a pipe around an axis thereof, the pipe being composed of a plastic-workable metal, (b) a jig, (c) a first device which moves the jig towards the pipe in a direction perpendicular to the axis until the jig makes contact with an outer surface of the pipe, and compresses the jig onto the pipe, (d) a second device which moves the jig in a direction in parallel with the axis with the jig being compressed onto the pipe while the pipe is kept rotated, and (e) a third device which controls a rate at which the jig is moved by the second device.

In yet another aspect of the present invention, there is provided a photosensitive drum to be used in an electrophotographic printer, the photosensitive drum being comprised of the above-mentioned circular-shaped metal structure.

In still yet another aspect of the present invention, there is provided a fixing belt to be used in an electrophotographic printer, the fixing belt being comprised of the above-mentioned circular-shaped metal structure.

In further another aspect of the present invention, there is provided a roller assembly including (a) at least two rollers arranged such that axes of the rollers are directed in parallel to each other, and (b) a belt wound around the rollers, the belt being comprised of the above-mentioned circular-shaped metal structure.

The advantages obtained by the aforementioned present invention will be described hereinbelow.

A printing technology in a printer or copier has remarkably developed. For instance, any document can be copied in full color. Hence, a black-and-white printer or copier will be required to have higher definition in the future, and a color printer or copier will be required to have a high quality and a high printing speed, and to be fabricated in a smaller cost. A photosensitive drum and a thermal fixing section are important keys to meet with such requirements.

In a thermal fixing roller or film, it is required to have a nip area as wide as possible in order to enhance a thermal coefficient and have a qualified image, regardless of whether a thermal fixing roller or film is of a belt type or a thin-walled sleeve type. In response to such requirement, a thin-walled circular-shaped metal structure fabricated in accordance with the invention can be used as a belt or sleeve having a high elasticity, high mechanical strength, and high resistance to fatigue.

The circular-shaped metal structure fabricated in accordance with the invention has higher durability, higher resistance to heat, higher rigidity and longer lifetime than those of a belt composed of resin or nickel, fabricated in accordance with the conventional method. The circular-shaped metal structure fabricated in accordance with the invention may be used as a belt. Hence, it will be possible to downsize a printer or copier by using the circular-shaped metal structure fabricated in accordance with the invention, as a belt, in place of a conventional roller or sleeve having a relatively great thickness.

In addition, the circular-shaped metal structure has a high thermal conductivity and a small thermal capacity. Accordingly, when the circular-shaped metal structure is used as a fixing drum, the fixing drum can be rapidly warmed up. Thus, a period of time for fixation can be shortened. In addition, the fixing drum would have a high thermal conductivity, resulting in reduction in power consumption, and hence, significant cost down.

For instance, the circular-shaped metal structure fabricated in accordance with the invention may be used as a belt in a photosensitive drum. Since a stainless steel of which the circular-shaped metal structure is made would have an enhanced strength by being spun, it would be possible to enhance a flatness and rigidity between axes when a tension force is applied to the circular-shaped metal structure used as a belt, in comparison with a conventional belt composed of resin.

In addition, when the circular-shaped metal structure is used as a belt, since the circular-shaped metal structure has a high Young's modulus, it would be possible to eliminate non-uniformity in rotation caused by extension and/or extraction, unlike a conventional belt composed of resin. As a result, accuracy in feeding could be enhanced, ensuring qualified images.

Most of conventional photosensitive drums are comprised of a big cylinder composed of aluminum. It would be possible to downsize a printer or copier by using the circular-shaped metal structure as a belt in place of such a conventional photosensitive drum. Furthermore, it would be possible in a color printer or copier to shorten a period of time in which a sheet passes a plurality of photosensitive drums associated with different colors such as red, green and blue, ensuring a high speed and reduction in a weight, and saving a space.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Hereinbelow is explained a method of fabricating a circular-shaped metal structure, in accordance with the embodiment. In the embodiment, it is assumed that a metal cylinder is fabricated as a circular-shaped metal structure in accordance with the method.

Figure 1:
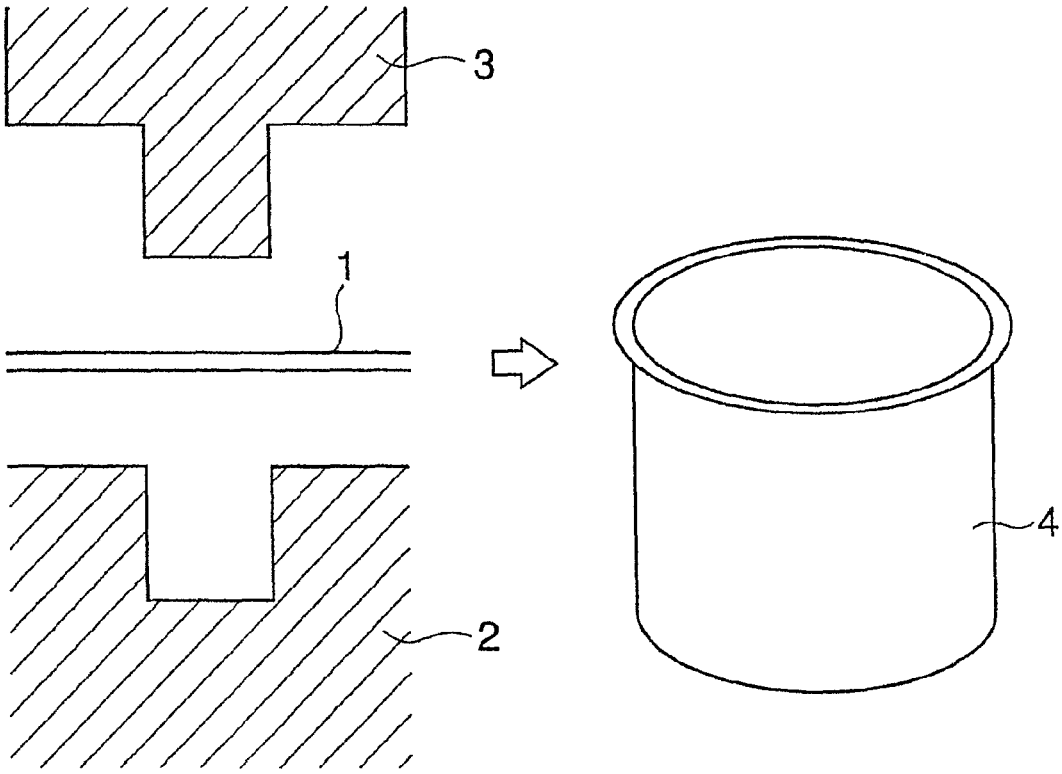
FIG. 1 includes cross-sectional and perspective views showing a step of fabricating a pipe having a bottom, by warm or cold drawing.

First, as illustrated in FIG. 1, a thin metal sheet 1 is placed between a female jig 2 and a punch 3 to fabricate a pipe 4 having a bottom. Deeper the pipe 4 is, more readily the pipe 4 can be spun. Hence, it is preferable that the pipe 4 is fabricated by warm drawing where the female jig 2 is heated and the punch 3 is cooled.

For instance, it is assumed that a SUS304 plate is pressed by warm and cold drawing. If a SUS304 plate is pressed at a room temperature, a critical drawing ratio, which is defined as a ratio of a diameter (A) of a cylindrical object to a diameter (B) of a punch (A/B), is 2.0. In contrast, if a SUS304 plate is pressed by warm drawing, a critical drawing ratio can be enhanced up to 2.6. Thus, when a pipe having a bottom is to be pressed, the pipe could be deeper if pressed by warm drawing than if pressed by cold drawing.

However, it should be noted that the pipe 4 having a bottom could be fabricated even by ordinary cold drawing.

In warm drawing, it is preferable for the metal sheet 1 to have a thickness in the range of 0.1 to 1.0 mm, and more preferable to have a thickness in the range of 0.3 to 0.5 mm.

Then, the pipe 4 is annealed such that the pipe 4 has a desired hardness.

Figure 2:
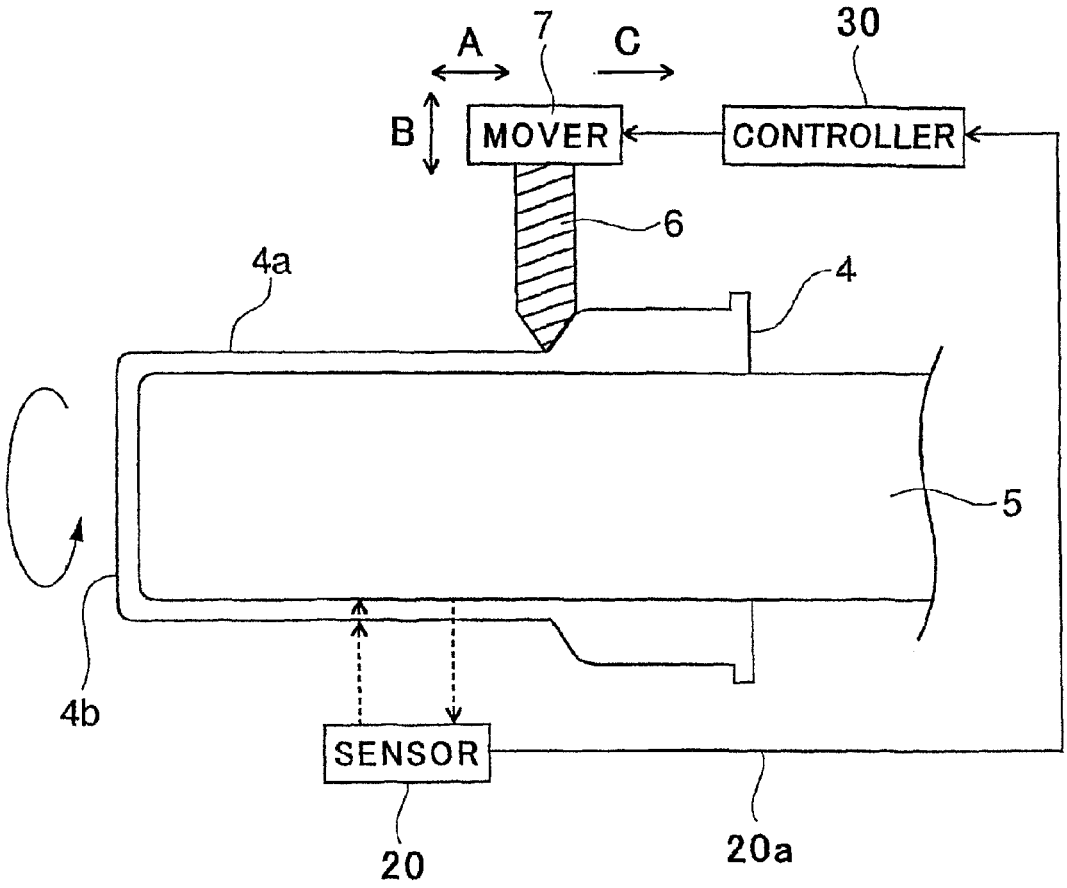
FIG. 2 is a cross-sectional view illustrating an apparatus of spinning a pipe.

Then, as illustrated in FIG. 2, the pipe 4 is subject to spinning working by means of a spinning machine.

The spinning machine is comprised of a pipe rotator 5 which rotates the pipe 4 around an axis thereof, a jig 6 having a top having an acute angle, a mover 7 movable both in a direction B perpendicular to the axis of the pipe 4 and in a direction A parallel to the axis of the pipe 4, a sensor 20 which measures a thickness of a wall 4*a* of the pipe 4 and transmits a signal 20*a* indicative of a measured thickness of a wall of the pipe 4, and a controller 30 which moves mover 7 in the direction B in accordance with the signal 20*a* transmitted from the sensor 20, to thereby reduce a thickness of a wall of the pipe 4, and controls a moving speed of the mover 7 in the direction A.

The jig 6 is fixed to the mover 7, and hence, can move both in the directions A and B together with the mover 7.

First, as illustrated in FIG. 2, the pipe rotator 5 is inserted into the pipe 4 having a bottom 4*b*, and then, the pipe rotator 5 starts rotating the pipe 4 around an axis of the pipe 4.

Then, the controller 7 moves the mover 7 and the jig 6 in the direction B until the jig 6 makes contact with an outer surface of a wall 4*a* of the pipe 4. Then, the controller 7 further moves the mover 7 and hence the jig 6 in the direction B such that the jig 6 is compressed onto the outer wall 4*a* of the pipe 4 at a uniform pressure. Then, spinning working to the outer wall 4*a* of the pipe 4 starts.

As mentioned earlier, the jig 6 is fixed to the mover 7. By moving the jig 6 through the mover 7, it is possible to locate the jig 6 remote from an outer surface of the pipe rotator 5 by a certain distance. As mentioned later, a distance between the jig 6 and an outer surface of the pipe rotator 5 would be equal to a thickness of a later mentioned metal cylinder 8.

Then, the mover 7 moves the jig 6 far away from a bottom 4*b* of the pipe 4, that is, to a direction C with the jig 6 being pressed onto the outer wall 4*a* of the pipe 4. As the jig 6 moves to the direction C, the outer wall 4*a* of the pipe 4 is drawn, and hence, lengthened and reduced in a thickness.

As a result, the pipe 4 would have a thickness equal to a distance between a top of the jig 6 and an outer surface of the pipe rotator 5.

In the embodiment, the jig 6 is designed to have a conical top for drawing the outer wall 4*a* of the pipe 4. As an alternative, a roller made of a hard material may be used in place of the jig 6.

The sensor 20 measures a thickness of the wall 4*a* of the pipe 4 in the direction A while the jig 6 draws the wall 4*a* of the pipe 4, and transmits a signal 20*a* indicative of the measured thickness of the wall 4*a* of the pipe 4, to the controller 30.

On receipt of the signal 20*a* from the sensor 20, if the controller 30 judges a thickness of the wall 4*a* is thicker than a predetermined thickness, the controller 30 moves the mover 7 further towards the pipe 4, that is, varies a pressure exerted onto an outer surface of the wall 4*a*, and causes the jig 6 to draw the wall 4*a* until the wall 4*a* reaches a predetermined thickness. Thus, the sensor 20 in cooperation with the controller 30 makes it possible for the wall 4*a* of the pipe 4 to have a constant thickness.

For instance, if the controller 30 judges a certain portion of the wall 4*a* is thicker than a predetermined thickness, the controller 30 may move the jig 6 back to the certain portion, and causes the jig 6 to draw the certain portion until the certain portion has a predetermined thickness.

Accordingly, when the pipe 4 is fabricated to have the wall 4*a* having a thickness equal to or smaller than 0.09 mm, it would be possible to form the wall 4*a* having a desired thickness with tolerance being within ±2.5 micrometers.

For instance, the sensor 20 may be comprised of a supersonic pulse reflection type sensor which transmits supersonic pulses to an object, and receives supersonic pulses having been reflected at the object. Since supersonic pulses reflect at different materials at different reflection rates, it would be possible to measure a thickness of the wall 4*a* of the pipe 4, if the pipe 4 and the pipe rotator 5 are composed of different materials from each other.

It should be noted that any sensor might be selected as the sensor 20 for sensing a thickness of the wall 4*a* of the pipe 4, unless it can measure a thickness of the wall 4*a*.

Though the mover 7 is designed as a single device in the embodiment, the mover 7 may be designed to be comprised of a first device for moving the jig 6 in the direction B and a second device for moving the jig 6 in the direction A.

The controller 30 further controls a speed at which the mover 7 moves in the direction A.

For instance, if the signal 20*a* shows that a thickness of the wall 4*a* is thicker than a predetermined thickness, the controller 30 may not only move the mover 7 further towards the pipe 4, but also move the mover 7 more slowly in the direction A, and causes the jig 6 to draw the wall 4*a* until the wall 4*a* reaches a predetermined thickness.

After the outer wall 4*a* has been drawn to a predetermined thickness in the above-mentioned way, the pipe 4 is taken away from the pipe rotator 5.

The spinning machine may be of a horizontal type or a vertical type. From the standpoint of workability, it is preferable to select a horizontal type spinning machine.

Figure 3:
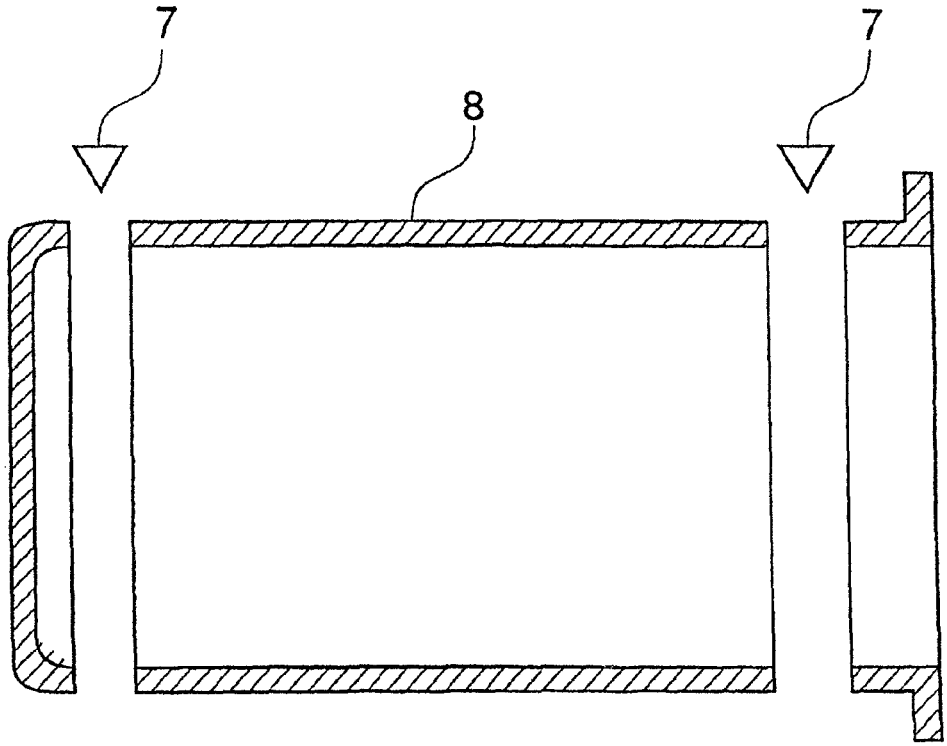
FIG. 3 is a cross-sectional view illustrating the step of cutting a pipe fabricated by spinning, at opposite ends thereof.

After the spinning work to the pipe 4 has been finished, the pipe 4 is cut at its opposite ends by means of a cutter 7 such that the pipe 4 has a desired length and having a thickness smaller than 0.03 mm, as illustrated in FIG. 3.

Then, the pipe 4 is finished so as to have an outer diameter at an opening end with a tolerance equal to or smaller than 0.05%.

For instance, if an opening end of the pipe 4 has an outer diameter of 30 mm, a tolerance is equal to or smaller than 15 micrometers.

Thus, there is obtained a metal cylinder 8 usable as a photosensitive or fixing drum.

While the pipe 4 is being rotated, it may be possible to control a pressure at which the jig 6 is compressed onto the wall 4*a* of the pipe 4 so as to accomplish a desired thickness of the wall 4*a*, a desired tolerance of the thickness, and a desired tolerance of an outer diameter of opening ends of the pipe 4.

Though the metal cylinder 8 is composed of SUS304, the metal cylinder may be composed of materials other than SUS. For instance, the metal cylinder may be composed of stainless steel, rolled nickel, nickel alloy, titanium, titanium alloy, tantalum, molybdenum, hastelloy, permalloy, marageing steel, aluminum, aluminum alloy, copper, copper alloy, pure iron or steel.

In the above-mentioned embodiment, the wall 4*a* of the pipe 4 is drawn by the single jig 6. Instead of the single jig 6, a plurality of jigs 6 may be used for drawing the pipe 4.

Figure 4:
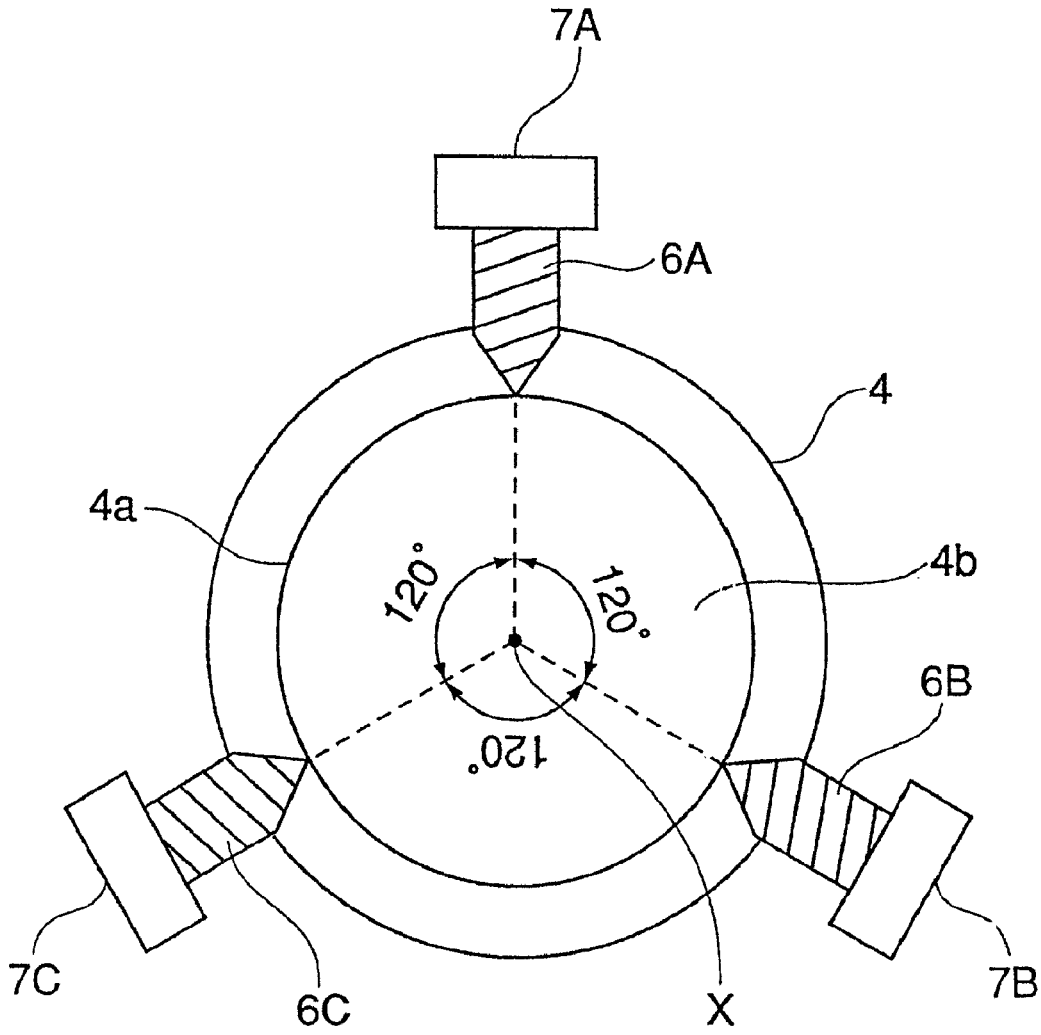
FIG. 4 is a cross-sectional view illustrating another apparatus of spinning a pipe.

FIG. 4 illustrates one example of arrangement of the jigs, in which three jigs 6A, 6B and 6C are arranged around a center of the pipe 4 in 120-degree circumference angles. Each of the jigs 6A, 6B and 6C is fixed to a mover 7A, 7B and 7C, respectively.

By drawing the wall 4*a* of the pipe 4 by means of the three jigs 6A, 6B and 6C, it would be possible to prevent deviation of an axis X of the pipe rotator 5 while the pipe 4 is drawn, ensuring that the wall 4*a* is drawn with high accuracy. As a result, the wall 4*a* can be drawn to a thickness or smaller than 0.03 mm, for instance.

It should be noted that two, four or more jigs may be used for drawing the pipe 4, in which case, it is preferable that the jigs are arranged around the pipe 4 at a common circumference angle.

Figure 5:
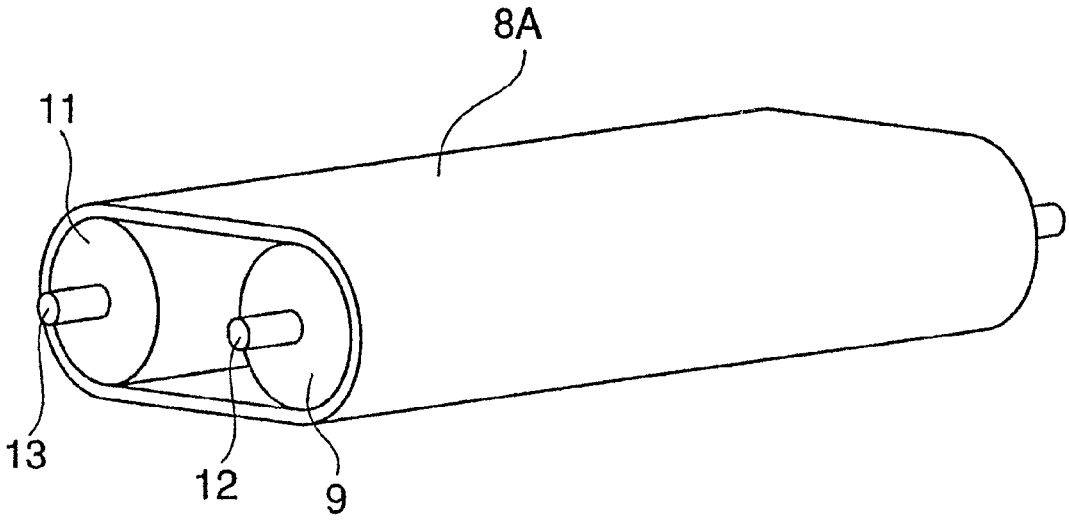
FIG. 5 is a perspective view of a cylindrical metal film used as a part of a roller assembly.
Figure 6:
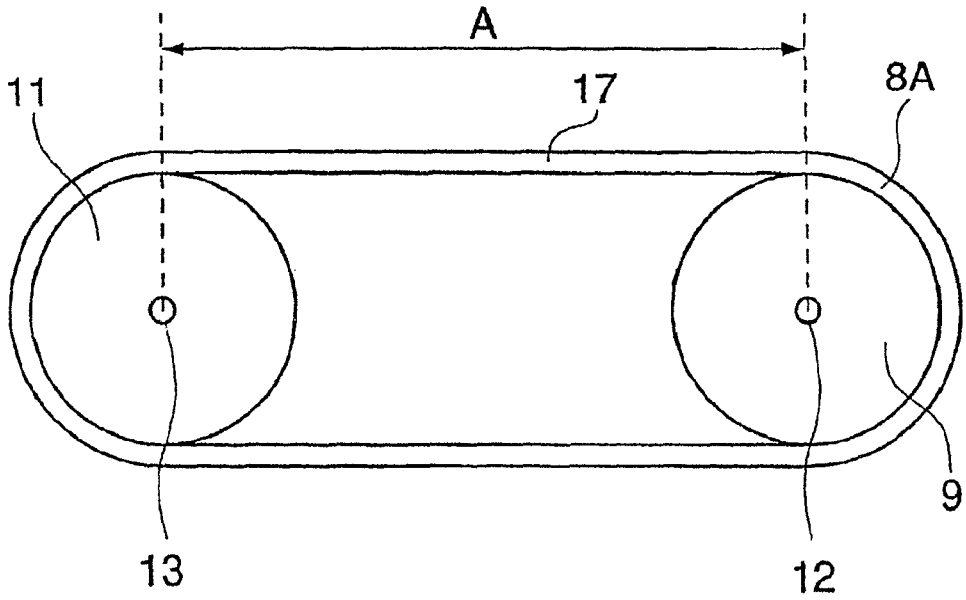
FIG. 6 is a front view of the roller assembly illustrated in FIG. 5.
Figure 7:
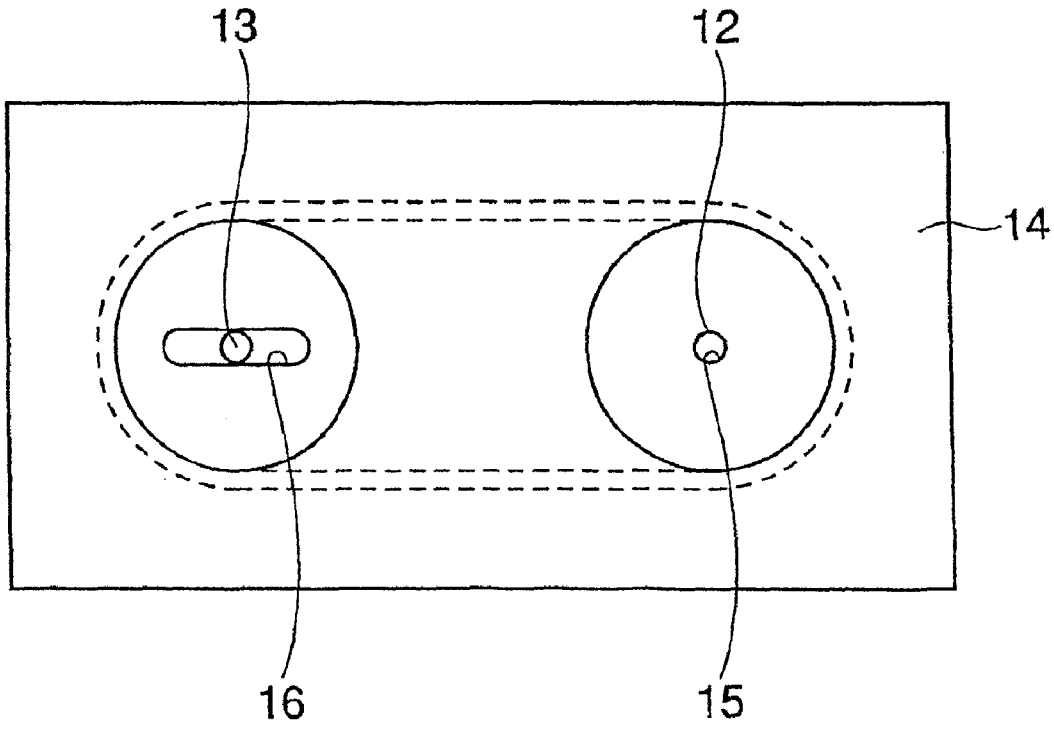
FIG. 7 is a front view of the roller assembly illustrated in FIG. 5.

FIGS. 5 to 7 illustrate an example of a use of the above-mentioned metal cylindrical film. As illustrated in FIGS. 5 to 7, the metal cylindrical film may be used as a part of a roller assembly.

As illustrated in FIGS. 5 and 6, a metal cylindrical film 8A is wound around two rollers 9 and 11 arranged such that axes of the rollers 9 and 11 are parallel to each other. The metal cylindrical film 8A has the same width as a length of the rollers 9 and 11, and hence, entirely covers the rollers 9 and 11 therewith.

The metal cylindrical film 8A is composed of SUS304, and has a thickness of 0.05 mm or 50 micrometers.

As illustrated in FIG. 5, each of the rollers 9 and 11 has a support shaft 12 and 13 projecting in an axis-wise direction thereof from opposite end surfaces of the rollers 9 and 11. As illustrated in FIG. 7, the rollers 9 and 11 are supported with sidewalls 14 at which the support shafts 12 and 13 are rotatably supported.

The sidewall 14 is formed with a circular hole 15 having the same diameter as a diameter of the support shaft 12, and an elongate hole 16 having a height equal to a diameter of the support shaft 13 and a horizontal length longer than a diameter of the support shaft 13.

The roller 9 is supported with the sidewall 14 by inserting the support shaft 12 into the circular hole 15. The roller 11 is fixed to the sidewall 14 by inserting the support shaft 13 into the elongate hole 16, and fixing the support shaft 13 at a desired location in the elongate hole 16 by means of a bolt and a nut, for instance. Thus, since the roller 11 can be fixed at a desired location, the metal cylindrical film 8A can be kept in tension by adjusting a location at which the roller 11 is fixed.

The roller assembly as illustrated in FIGS. 5 to 7 may be used as a photosensitive drum, or a heater roll or a fixing roll in a printer.

The roller 9 and 11 can have a smaller diameter than a diameter of a conventional photosensitive drum. Hence, it would be possible to fabricate a photosensitive drum having a smaller height than a height of a conventional photosensitive height. Thus, by incorporating the roller assembly including the metal cylindrical film 8A, into a printer, it would be possible to make a height of a printer significantly smaller.

Since a conventional heater roll is cylindrical in shape, there exists no planar portion on an outer surface of the heater roll. In contrast, the roller assembly including the metal cylindrical film 8A has a planar portion 17 on the metal cylindrical film 8A in dependence on a distance between the rollers 9 and 11, as illustrated in FIG. 6.

For instance, toner adhering to a paper can be thermally fixed onto the paper on the planar portion 17, which ensures a wider area for thermally fixating toner, than an area presented by a conventional heater roll. As a result, it would be possible to carry out thermal fixation more stably, ensuring enhancement in a quality of printed images and/or characters.

As an alternative, a developing unit may be arranged on the planar portion 17.

In addition, since the metal cylindrical film 8A is thin, the metal cylindrical film 8A has a high thermal conductivity. That is, heat is likely to be transferred through the metal cylindrical film 8A. This ensures it possible to remarkably shorten a period of time necessary for heating a heater roll in comparison with a conventional heater roll. Accordingly, it is possible to shorten a period of time after a printer has been turned on until the printer becomes workable.

Figure 8:
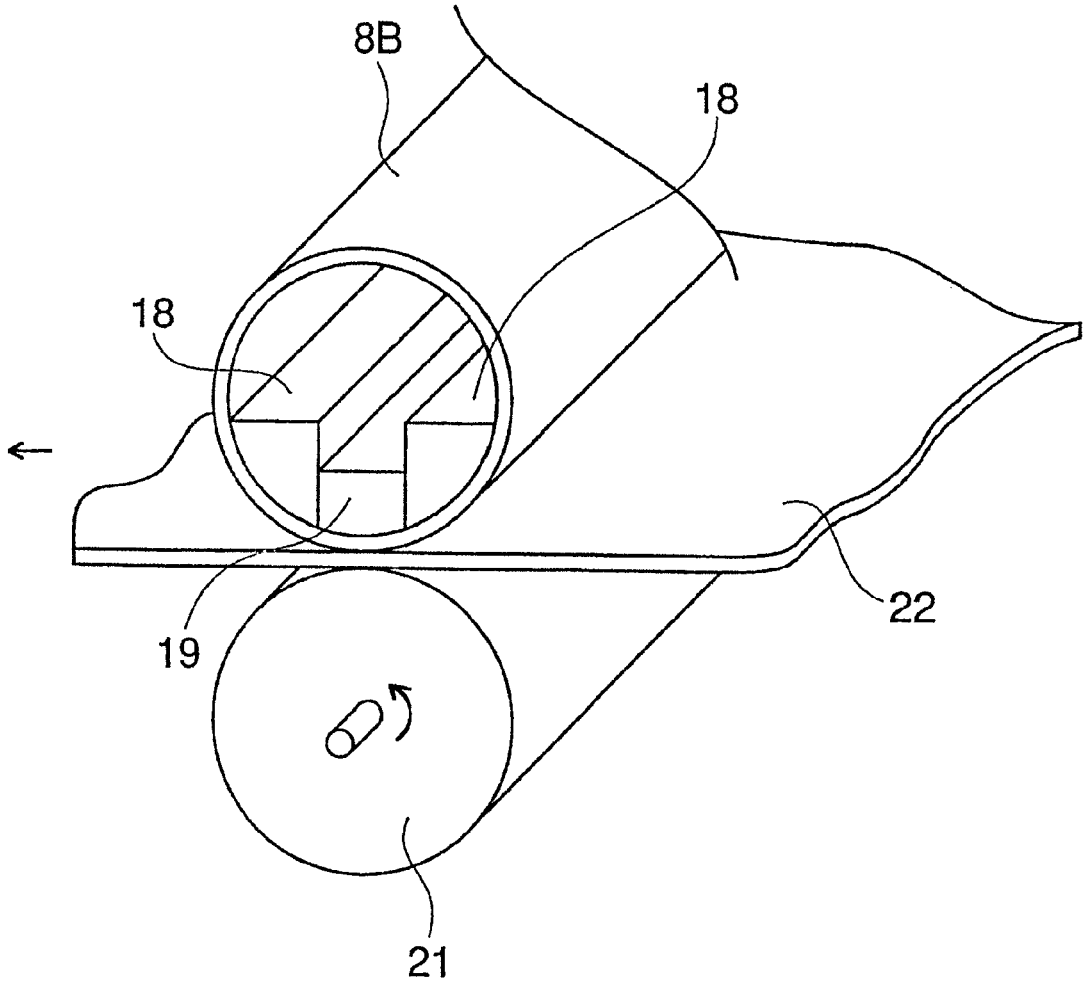
FIG. 8 is a perspective view of a cylindrical metal film used as a fixing roller.

FIG. 8 shows another use of a metal cylindrical film.

A metal cylindrical film 8B may be used as a thermally fixing roll. As illustrated in FIG. 8, a pair of guides 18 is incorporated in the metal cylindrical film 8B. The guides 18 have an arcuate outer surface, and hence, can keep the metal cylindrical film 8B to be a cylinder.

A heater 19 is sandwiched between the guides 18. The heater 19 is comprised of a halogen lamp or a ceramic heater, for instance.

A nip roll 21 is located in facing relation to the metal cylindrical film 8B formed as a thermally fixing roll.

A sheet 22 to which toner is adhered is fed towards the metal cylindrical film 8B and the nip roll 21, and then, sandwiched between the metal cylindrical film 8B and the nip roll 21, and subsequently, heated by the heater 19. As a result, toner is thermally fixed to the sheet 22.

By using the metal cylindrical film 8B as a thermally fixing roll, the heater 19 can be arranged in the metal cylindrical film 8B, and hence, heat generated by the heater 19 can be transferred directly to the metal cylindrical film 8B. Thus, it would be possible to significantly enhance a heat transfer efficiency from the heater 19 to the metal cylindrical film 8B.

In addition, since the metal cylindrical film 8B is formed of a thin metal sheet, it is possible to rapidly heat the metal cylindrical film 8B up to a temperature necessary for fixing toner onto the sheet 22. Namely, it is possible to shorten a period of time after a printer has been turned on until the printer becomes workable.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-81679 filed on Mar. 22, 2003, including specification, claims, drawings and summary is incorporated herein by reference in its entirety.

What is claimed is:

1. A method of fabricating a circular-shaped metal structure, comprising the steps of:

(a) rotating a pipe around an axis thereof, said pipe being composed of a plastic-workable metal;

(b) moving a jig towards said pipe in a direction perpendicular to said axis until said jig makes contact with an outer surface of said pipe, and compressing said jig onto said pipe;

(c) moving said jig in a direction in parallel with said axis with said jig being compressed onto said pipe while said pipe is kept rotated;

(d) measuring a thickness of a wall of said pipe during said step (c); and (e) adjusting a pressure with which said jig is compressed onto said pipe, in accordance with said thickness measured in said step (d).

2. The method as set forth in claim 1, wherein said plastic-workable metal is selected from a group consisting of stainless steel, rolled nickel, nickel alloy, titanium, titanium alloy, tantalum, molybdenum, hastelloy, permalloy, marageing steel, aluminum, aluminum alloy, copper, copper alloy, pure iron and steel.

3. A method of fabricating a circular-shaped metal structure, comprising the steps of:

(a) rotating a pipe around an axis thereof, said pipe being composed of a plastic-workable metal;

(b) moving a jig towards said pipe in a direction perpendicular to said axis until said jig makes contact with an outer surface of said pipe, and compressing said jig onto said pipe;

(c) moving said jig in a direction in parallel with said axis with said jig being compressed onto said pipe while said pipe is kept rotated; and (d) controlling a speed at which said jig is moved in said step (c).

4. The method as set forth in claim 3, wherein said plastic-workable metal is selected from a group consisting of stainless steel, rolled nickel, nickel alloy, titanium, titanium alloy, tantalum, molybdenum, hastelloy, permalloy, marageing steel, aluminum, aluminum alloy, copper, copper alloy, pure iron and steel.

5. The method as set forth in claim 3, wherein the speed is controlled to accomplish a thickness with a desired tolerance equal to or smaller than ±2.5 micrometers.

6. The method as set forth in claim 3, wherein the speed is controlled to accomplish a thickness smaller than 0.03 mm.

7. The method as set forth in claim 3, wherein said circular-shaped metal structure has opposite opening ends, an outer diameter of said opening ends having a tolerance equal to or smaller than 0.05% of a desired outer diameter.

8. A method of fabricating a circular-shaped metal structure, comprising the steps of:

(a) rotating a pipe around an axis thereof, said pipe being composed of a plastic-workable metal;

(b) moving a jig towards said pipe in a direction perpendicular to said axis until said jig makes contact with an outer surface of said pipe, and compressing said jig onto said pipe;

(c) moving said jig in a direction in parallel with said axis with said jig being compressed onto said pipe while said pipe is kept rotated; and (d) controlling both a pressure at which said jig is compressed onto said pipe in at least one of said steps (b) and (c), and a speed at which said jig is moved to accomplish a thickness with a desired tolerance.

9. The method as set forth in claim 8, wherein said desired tolerance is equal to or smaller than ±2.5 micrometers.

10. The method as set forth in claim 8, wherein said thickness is smaller than 0.03 mm.

11. The method as set forth in claim 8, wherein said circular-shaped metal structure has opposite opening ends, an outer diameter of said opening ends having a tolerance equal to or smaller than 0.05% of a desired outer diameter.

* * * * *